United States Patent [19]

Remond

[11] 4,149,572

[45] Apr. 17, 1979

[54] DEVICE FOR RE-TENSIONING A WEFT THREAD UNWINDING IN A SHUTTLE-LESS LOOM

[75] Inventor: Pierre Remond, Bourgoin-Jallieu, France

[73] Assignee: Saurer Diederichs Societe Anonyme, Bourgoin-Jallieu, France

[21] Appl. No.: 795,895

[22] Filed: May 11, 1977

[30] Foreign Application Priority Data

May 17, 1976 [FR] France ..... 76 15582

[51] Int. Cl.[2] ..... D03D 47/34

[52] U.S. Cl. ..... 139/452

[58] Field of Search ..... 139/450, 452; 226/97, 226/113, 117, 118

[56] References Cited

U.S. PATENT DOCUMENTS

| | | | |
|---|---|---|---|
| 3,024,814 | 3/1962 | Te Strake | 139/452 |
| 3,110,325 | 11/1963 | Strake | 139/435 |
| 3,395,737 | 8/1968 | Wueger | 139/452 |
| 3,736,964 | 1/1973 | Budzyna | 139/452 |
| 3,865,149 | 2/1975 | Keldany | 139/452 |

FOREIGN PATENT DOCUMENTS

| | | | |
|---|---|---|---|
| 562346 | 5/1975 | Switzerland | 139/452 |

*Primary Examiner*—Henry Jaudon
*Attorney, Agent, or Firm*—Karl F. Ross

[57] ABSTRACT

A retensioning device for a shuttle-less loom in which the yarn is drawn from a yarn reserve through a pair of eyelets and a thread brake for insertion, e.g. by lances into the warp, comprises a falt chamber defined between a fixed lower plate and a movable upper plate having an opening through which the head of a nozzle passes in the closed position of the upper plate. The nozzle directs a flat stream of air into the chamber to cause the yarn therein to describe a loop with the sides of the loop nearly parallel to one another, thereby preventing tangling.

2 Claims, 5 Drawing Figures

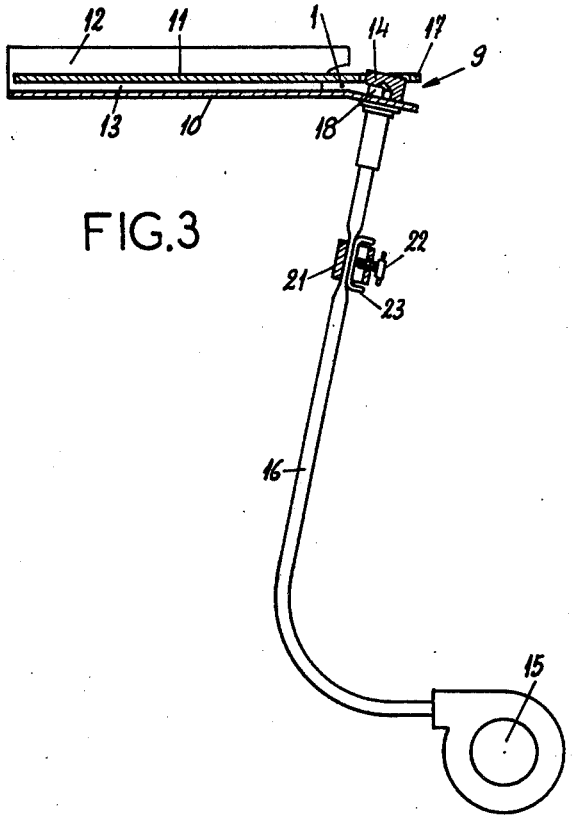
FIG.3
FIG.4
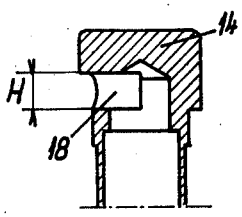
FIG.5
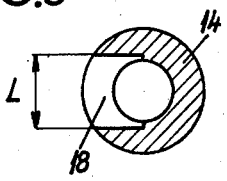

DEVICE FOR RE-TENSIONING A WEFT THREAD UNWINDING IN A SHUTTLE-LESS LOOM

FIELD OF THE INVENTION

The present invention relates to a device for re-tensioning a weft thread unwinding in a shuttle-less loom and more precisely a loom in which the weft is drawn from a fixed yarn reserve located on one side of the machine, by mechanical weft-feed means, such as lances moving transversely.

BACKGROUND OF THE INVENTION

In a loom of this type, if the weft thread stored on the supply bobbin is withdrawn directly, owing to the high speed of the lances and the inertia of the weft thread, a "balloon" is formed, i.e. a greater or lesser excess length of unwound yarn depending on the density of the yarn.

When unwinding stops, which takes place at precise points in the cycle of the loom, this excess length of weft forms a loop whose two sides may, depending on their degree of twisting, join together and wind one around the other to form a kink. Generally, this kink cannot come undone itself and it will be introduced into the shed when the pulling lance once more entrains the weft thread, thereby causing a fault in the fabric.

A known solution making it possible to eliminate this drawback consists of effecting a preliminary unwinding of the weft and storing the unwound length provisionally on a device comprising a drum. This device unwinds the yarn at virtually constant speed, which reduces the "balloon" effect. The winding on a drum generally makes it possible to eliminate the kinks in the yarn. The major drawback of this system is its very high cost.

OBJECT OF THE INVENTION

The present invention intends to provide simpler and less expensive means for preventing the formation of kinks, without resorting to a device for preliminary unwinding.

SUMMARY OF THE INVENTION

The invention attains the object with a device for re-tensioning a weft thread as it unwinds, in a loom of the type in question, which comprises means producing a channelled current of air which allows the thread to form a loop between two fixed points.

This device re-tensions the weft thread immediately after each stoppage in the unwinding operation, by a blast of air giving the yarn the shape of a hairpin between the two fixed points which are, for example, eyelets through which the thread passes.

In a preferred embodiment of this device, for channelling the current of air, the latter comprises a chamber of slight depth (i.e. generally flat chamber) defined by two parallel plates, one plate being stationary and provided with side (lateral) flanges substantially parallel to the direction of the air stream and the other being removable. The spacing of the two plates should be chosen so as to leave ample space for the passage of the yarn, in order that the loop may form freely, while preventing kinking of the yarn when the device is stationary.

The stationary plate advantageously supports an air-ejection nozzle located substantially equidistantly from the two side flanges of said plate and having its outlet orifice facing the central part of the chamber defined by the two plates. Furthermore, the outlet orifice of the nozzle preferably has a flat rectangular shape, its height being significantly less than its width. This arrangement makes it possible to obtain a virtually laminar air stream directed accurately between the two plates such that the loop formed by the yarn is roughly symmetrical and has two substantially parallel sides, spaced apart to the maximum extent and which cannot twist one around the other.

The removable plate is withdrawn to facilitate introduction of the weft thread in the device. To ensure positioning of the removable plate, the latter comprises an opening for example which, when this plate is in position, is traversed by the top of the nozzle. Advantageously, this removable plate is transparent, which makes it possible to observe the device during operation and above all when it is regulated, which takes place by modifying the air flow.

In a particular embodiment, the air is supplied through a flexible tube, on which is placed a device for regulating the rate of flow. The device acts by pinching of the tube to modify the section of the supply tube.

BRIEF DESCRIPTION OF THE DRAWING

The invention will be better understood from the following description, referring to the accompanying diagrammatic drawing illustrating, an embodiment of the device of the invention for re-tensioning an unwinding weft thread.

In the drawing:

FIG. 3 is a vertical sectional view taken along line 3—3 of FIG. 2 and;

FIGS. 4 and 5 are partial views, to an enlarged scale, showing solely the nozzle, respectively in vertical and horizontal section.

SPECIFIC DESCRIPTION

Figure 1:
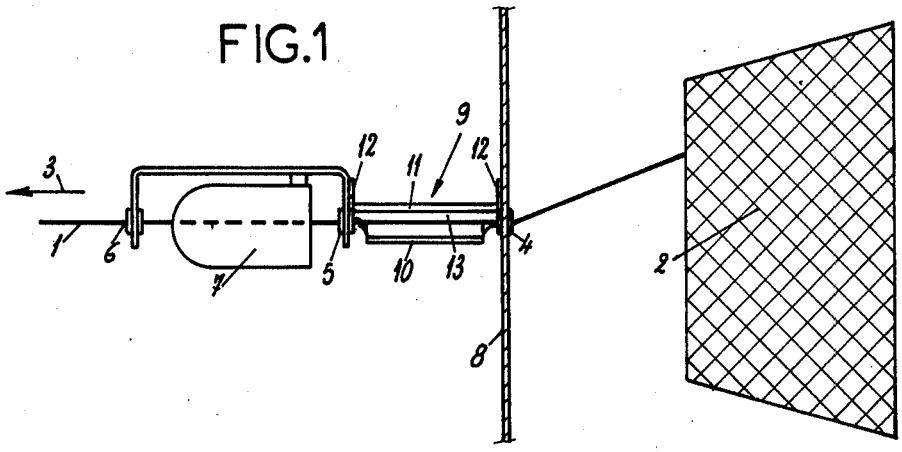
FIG. 1 is a front-elevational view of the device according to the invention, the nozzle being removed.
Figure 2:
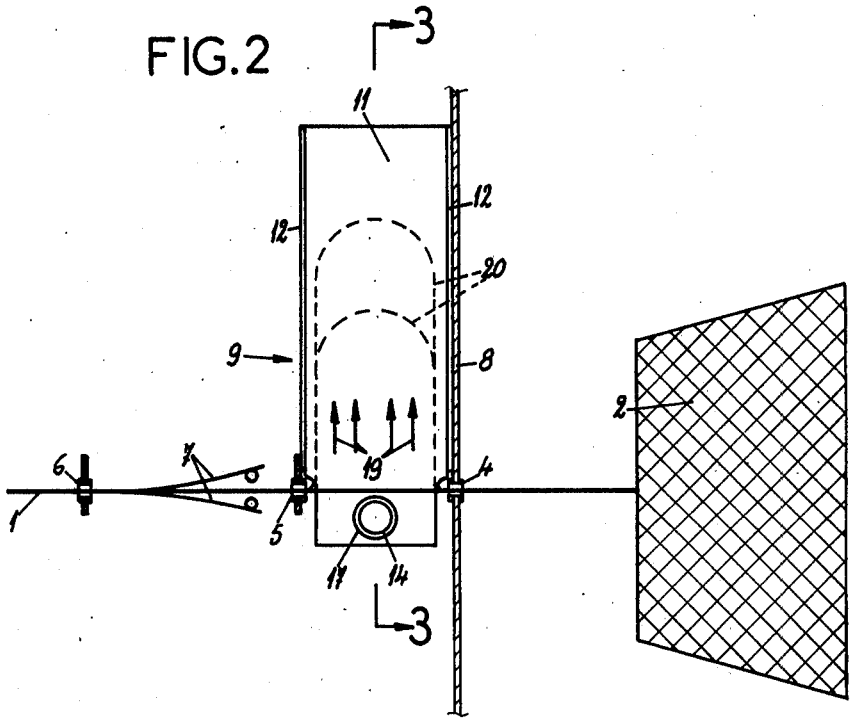
FIG. 2 is a plan view of the device.

The invention relates to a shuttle-less loom in which the weft thread 1, coming from a stationary supply bobbin 2 located on one side of the machine, is entrained by a lance (not shown) in the direction of arrow 3 in FIG. 1, the yarn passing through yarn-guide eyelets 4, 5 and 6 as well as between braking plates 7, known per se. In the device of the invention, the bobbin 2 is surrounded by a casing 8 shown partly in FIGS. 2 and 3, the purpose of which is to prevent the weft thread, while unwinding and forming the above-mentioned "balloon," from becoming attached to any part of the machine.

The device according to the invention, designated generally by the reference numeral 9, is located between the first eyelet 4, through which the yarn passes from the casing 8 and the second eyelet 5. It comprises a lower plate 10 and an upper plate 11, the lower plate 10 comprising two parallel flanges 12 directed upwards in order to define with the upper plate 11, a chamber 13 of slight thickness as shown clearly in FIG. 3.

The lower plate 10 is constituted by a fixed metal part whose flanges 12 extend in a direction at right-angles to the straight line joining the two eyelets 4 and 5. This plate 10 supports an air-ejection nozzle 14, located in front of the eyelets 4 and 5 and at equal distances from the latter, i.e. along the axis of the device 9. The nozzle 14 is connected to a turbine-operated fan 15 by means of a flexible tube 16, as shown in FIG. 3.

The upper plate 11 is a transparent part, made for example from Derspex. It is removable and has a circular opening 17 through which, when the plate is in position, the upper part of the nozzle 14 passes.

The outlet orifice 18 of the nozzle 14 is directed to face the central part of the chamber 13 defined by the plates 10 and 11. This orifice has a flat rectangular shape, as shown in FIGS. 4 and 5, its height H clearly being less than its width L.

When the loom in question is operating, the blower 15 continuously sends a flow of air into the tube 16, which air escapes through the outlet orifice 18 of the nozzle 14. Owing to the flattened shape of this orifice, to its position and its orientation, there is obtained between the plates 10 and 11 a laminar air stream, represented by the arrows 19 of FIG. 1, whose direction is at right-angles to the straight line joining the eyelets 4 and 5, which stream travels through the device 9 from front to back, in order to escape at the open end of the latter opposite the nozzle 14.

During the periods, depending on the cycle of the loom, when the weft thread 1 is not withdrawn, the latter is retained between the braking plates 7. However, the thread may still unwind under the effect of inertia and gravity and consequently become slack and it is here that the device 9 according to the invention intervenes.

Assuming that the thread is slack between the bobbin 2 and the braking plates 7, the air stream passing through the chamber 13 tends to entrain the yarn and cause the yarn to describe a loop 20 of variable length between the eyelets 4 and 5, inside the chamber 13 located between the plates 10 and 11. The laminar distribution of air makes it possible to obtain a virtually symmetrical loop 20, the two sides of which are substantially parallel to the flanges 12 of the plate 11 and very close to these flanges, the sides of the loop being therefore spaced apart to the maximum extent, which makes it possible to re-tension the yarn and prevent its kinking.

The flow of air passing through the flexible tube 16 and should be able to be regulated depending on the size of the weft thread 1, an equilibrium having to be found in order to re-tension the yarn without unwinding the bobbin 2. To this end, a device for regulating the rate of flow is located on the tube 16. This device, shown in FIG. 3, is based on the principle of pinching the tube and it comprises a tubular body 21, surrounding the tube 16, which comprises a screw 22 acting on a small plate 23 pressed against the tube. The transparency of the of the upper plate 11 facilitates regulation of the rate of flow, thus facilitating checking of the effect obtained. It is also possible to act on the spacing of the two plates 10 and 11 to obtain correct adjustment.

The description of the device 9 according to the invention was hitherto made considering a single weft thread 1, but the invention relates to machines making it possible to weave with several weft threads, in which case the device 9 is a multichamber device, however the blower 15 being common to them all.

Naturally and as is apparent from the aforesaid, the invention is not limited to the single embodiment of this device for re-tensioning a weft thread, which was described above by way of example. On the contrary, it includes all variations of construction and application.

Thus, in particular, in the case of slightly twisted weft threads, the removable plate 11 may possibly be eliminated, the laminar air stream remaining in contact with the single fixed plate 10 and making it possible to obtain the desired result by means of the shape and direction of the orifice of the nozzle 14, as well as by the shape of the plate 10 and its flanges 12.

I claim:

1. In a shuttle-less loom having a weft-insertion lance for introducing a weft yarn drawn from a bobbin into a warp, the combination therewith which comprises:

a pair of spaced-apart weft guides traversed by said yarn between said lance and said bobbin, said weft guides including a weft guide close to said bobbin;

a flat chamber having a mouth disposed between said weft guides and defined between a part of parallel walls extending transversely to a line extending between said guides and to one side of this line;

an air jet nozzle disposed on the opposite side of said line and having an outlet trained into said chamber for directing a continuous stream of air against the yarn between said guides for extending the yarn into a loop within said chamber, said nozzle lying substantially along a median axis of said chamber;

means for feeding said nozzle with air under pressure, said walls being constituted by a fixed plate and a readily removable plate respectively, said nozzle being mounted on said fixed plate, said movable plate having an opening traversed by said nozzle, said nozzle having a slot-shaped opening constituting said outlet for directing a flat stream of air into said chamber and being disposed equidistantly between said guides, said means for supplying air under pressure to said nozzle including a flexible-wall tube and a blower connected to said tube; and a pinch valve engaging a wall of said tube for controlling the flow through said outlet.

2. The combination defined in claim 1 wherein said movable plate is transparent.

* * * * *